US011280030B2

(12) United States Patent
Sear

(10) Patent No.: US 11,280,030 B2
(45) Date of Patent: Mar. 22, 2022

(54) TEXTILE INTERLACING JET WITH SMOOTH YARN CHANNEL

(71) Applicant: Nicolas Charles Sear, Winston-Salem, NC (US)

(72) Inventor: Nicolas Charles Sear, Winston-Salem, NC (US)

( * ) Notice: Subject to any disclaimer, the term of this patent is extended or adjusted under 35 U.S.C. 154(b) by 428 days.

(21) Appl. No.: 15/990,878

(22) Filed: May 29, 2018

(65) Prior Publication Data

US 2019/0368079 A1 Dec. 5, 2019

(51) Int. Cl.
*D02J 1/08* (2006.01)
*D02G 1/16* (2006.01)

(52) U.S. Cl.
CPC ..... *D02J 1/08* (2013.01); *D02G 1/168* (2013.01)

(58) Field of Classification Search
CPC ..... D02J 1/08; D02J 1/00; D02G 1/16; D02G 1/162
See application file for complete search history.

(56) References Cited

U.S. PATENT DOCUMENTS 3,110,950 A * 11/1963 Yamamoto ..... D02G 1/161 28/273
3,333,313 A * 8/1967 Gilmore ..... D02J 1/08 28/275
4,679,284 A * 7/1987 Naylor ..... D02J 1/08 28/272
5,146,660 A * 9/1992 Ritter ..... D02J 1/08 28/274
5,325,572 A * 7/1994 Dickson, III ..... D02G 1/167 28/271
5,398,392 A * 3/1995 Sano ..... D02J 1/08 28/276
5,964,015 A * 10/1999 Sear ..... D02J 1/08 28/274
6,438,812 B1 * 8/2002 Jansen ..... D02G 1/161 28/272
6,609,278 B1 * 8/2003 Ritter ..... D02G 1/162 28/271
6,834,417 B1 * 12/2004 Buchmuller ..... D02G 1/161 28/271
6,868,593 B1 * 3/2005 Mitsuhashi ..... D02J 1/08 28/271
7,353,575 B2 * 4/2008 Buchmuller ..... D02J 1/08 28/271
7,707,699 B2 * 5/2010 Belforte ..... D02J 1/08 28/274
9,447,526 B2 * 9/2016 Stundl ..... D02G 1/161
2003/0110754 A1 * 6/2003 Simmen ..... D02G 1/161 57/289

* cited by examiner

*Primary Examiner* — Jillian K Pierorazio

(57) ABSTRACT

A textile jet subassembly includes a textile jet or jet nozzle mounted on a base support. An upper impact plate and a lower insert plate form the yarn channel passing through the jet or jet nozzle. A jet interface and a threading slot communicate with the yarn channel and the sidewalls above and below the threading slot are coplanar to form a smooth surface. Multiple alignment or registration recesses and cooperating pin fasteners are spaced from the yarn channel on the same side of the yarn channel to properly align the side walls above and below the threading slot.

35 Claims, 13 Drawing Sheets

FIG 4
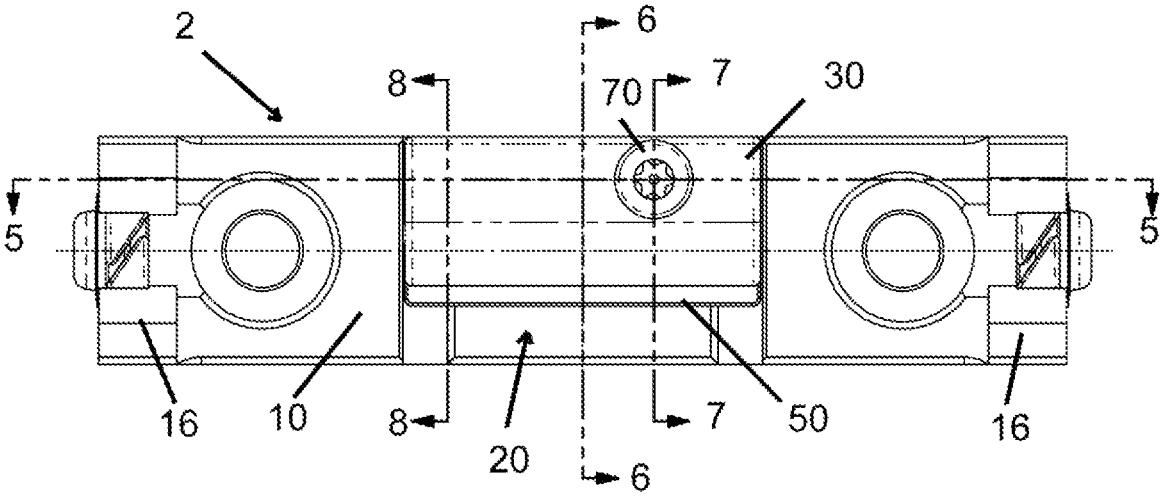
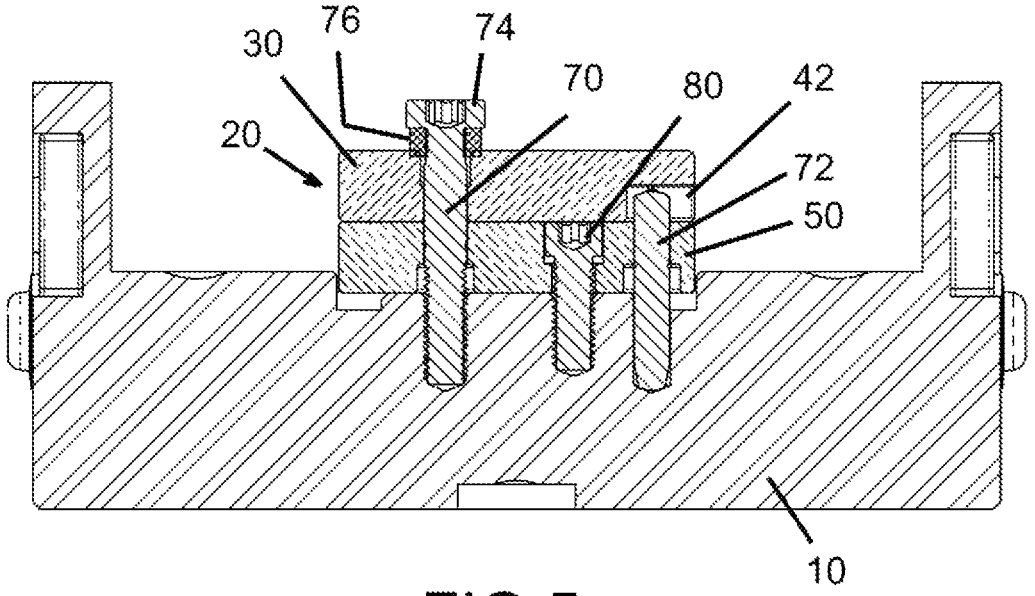
FIG 5

FIG 18
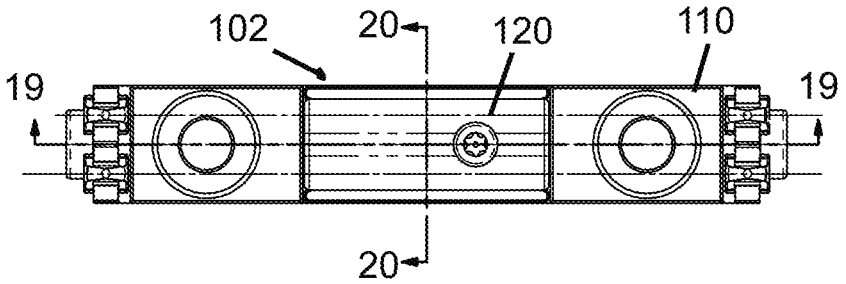
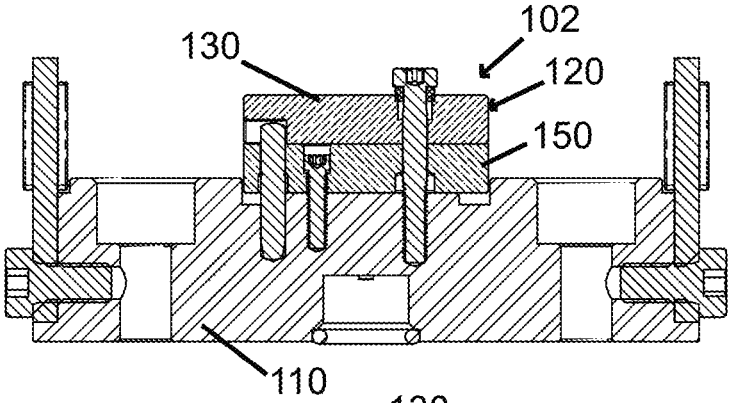
FIG 19
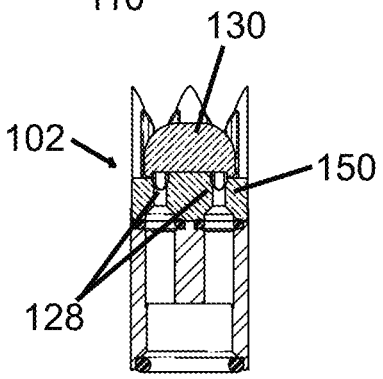
FIG 20

FIG 21
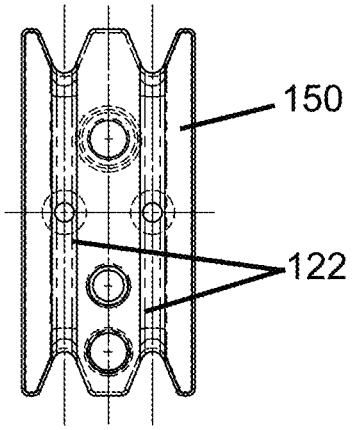
FIG 23
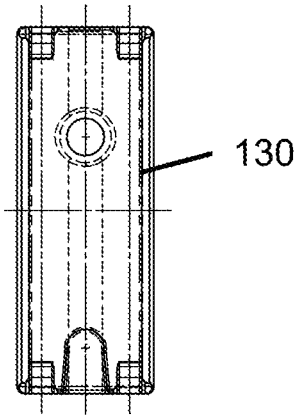
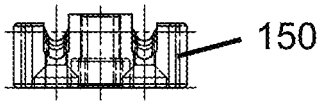
FIG 22
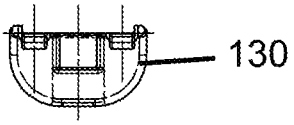
FIG 24

TEXTILE INTERLACING JET WITH SMOOTH YARN CHANNEL

CROSS REFERENCE TO PRIOR CO-PENDING APPLICATION

This application claims benefit of prior Provisional Patent Application 62/518,758 filed Jun. 13, 2017.

BACKGROUND OF THE INVENTION

Field of the Invention

This invention relates to textile jets for interlacing multifilament yarn to form knots between the filaments, and to a jet nozzle with an impact plate and an insert plate forming a yarn channel with smooth sidewalls.

Description of the Prior Art

U.S. Pat. No. 4,679,284 discloses a yarn processing air jet in which a yarn channel and a threading slot are formed by upper and lower metal parts that are held together by bolts. The lower part defines the lower portion of the yarn channel and one wall of the yarn channel below the threading slot. The upper part forms the top of the yarn channel and the portion of one wall above the threading slot. The yarn channel wall opposite the threading slot is formed by the lower part which abuts the upper part at the top of the yarn channel. The cross section of the yarn channel is triangular the yarn channel diverges from an air inlet toward the yarn channel outlet.

U.S. Pat. Nos. 5,010,631 and 5,146,660 disclose two piece textile jets with a continuous yarn channel for intermingling or interlacing multifilament yarns. The yarn channels in each of these patents are formed by a lower nozzle section including an air inlet and an upper baffle section, opposed to the air inlet. Each device also has a threading slot extending into one side of the yarn channel. Both baffle section sides are offset relative to the yarn channel. However, it is believed that in practice this exposed edge tends to damage or abrade the yarn filaments. It is therefore desirable that the edge of the top section be in alignment with the adjacent edge of the bottom section so that the top edge does not protrude or extend into the yarn channel beyond the adjacent the bottom edge. However, this requires substantially precise alignment which needs to be assured and repeatable in a production environment. The instant invention provides such assurance, and two piece jet nozzles can be easily assembled so that the set up time for multiple jet nozzles is minimized.

U.S. Pat. No. 5,964,015 discloses a textile jet nozzle in which the location of the horizontal transition of an insert plate and impact plate is on the same plane as the top channel surface. This eliminates the traditional stepped side walls which optimizes vortex air flow and reduces abrasion. Smooth channel walls result in smooth vortices by eliminating violent vortex air flow over side wall steps and reduces dilution of vortex parallel to lacing slot from incoming vacuum induced air The physical yarn properties of elongation and tenacity of delicate yarns are improved due to lower filament abrasion. The violent vortex air flow beats the filaments on the edges on stepped side walls. The instant invention includes the same yarn channel configuration of U.S. Pat. No. 5,964,015 to maintain smooth vortex and reduce filament and yarn abrasion, but employs a structure that is more efficient to manufacture and can be employed in a configuration in which the thread spacing between jets is less than was possible with the configuration disclosed in U.S. Pat. No. 5,964,015.

SUMMARY OF THE INVENTION

A jet for air interlacing multifilament textile yarn includes an insert plate and an impact plate forming a yarn channel and a threading slot and a centrally positioned jet orifice communicating with the yarn channel. The yarn channel has parallel opposed side walls and having a lower convex surface formed in the insert plate and an upper surface formed by the impact plate. The insert plate includes a side wall forming a portion of one yarn channel side wall below the threading slot. The impact plate includes a lip having a side wall forming a portion of the yarn channel side wall above the threading slot. First and second pins align the impact plate relative to the insert plate so that the side wall of the lip above the threading slot is in the same plane as the side wall of the insert plate below the threading slot. The impact plate and the insert plate each have pairs of mutually alignable female registration recesses on a same side of the channel with the pairs of female registration recesses on the impact plate and the insert plate also being aligned along a single side of the yarn channel. The side wall of the lip above the threading slot is thus aligned with the side wall of the insert plate below the threading slot in approximately the same plane when the first and second pins are received in the two mutually alignable female registration recesses.

According to another aspect of this invention the textile jet assembly, for interlacing multifilament textile yarn, comprising a base support on which an insert plate and an impact plate are mounted to form a yarn channel between the insert plate below and the impact plate above with a threading slot on a first side of the yarn channel. A jet orifice extends through the base support and the insert plate to communicate with the yarn channel between opposite ends thereof. First, second, and third pin fasteners are aligned relative to to and along only the same single side of the yarn channel, and secure the base support, the insert plate and the impact plate together. Faces or sidewalls of the yarn channel above and below the threading slot are coplanar to prevent abrasion of the textile yarn. The first pin fastener extends only through the insert plate and into the base support. The second pin fastener extends through the impact plate and the insert plate and into the base support. The third pin fastener extends through the insert plate and only partially into the base support and the impact plate to form a slim textile jet assembly so that multiple textile jet assemblies may be positioned side by side on closely spaced centerlines to form a multijet assembly.

A method of assembling this textile jet nozzle for interlacing multifilament textile yarn can include the following steps. A first registration pin is inserted into a first hole in the insert plate. The lower surface of the impact plate slides along the upper surface of the insert plate until the first registration pin is received in the slotted recess with debris between the upwardly and downwardly facing surfaces being removed by as the surfaces slide relative to each other. Subsequently a second insert plate holes is aligned with the impact plate hole, and a second registration pin is inserted through the aligned second of the insert plate holes and an impact plate hole so that opposite yarn channel sides on the impact plate and the insert plate are aligned to improve interlacing the multifilament textile yarn.

BRIEF DESCRIPTION OF THE FIGURES

FIG. 4 is a top view of the textile jet assembly of FIGS. 1-3.

FIG. 5 is a longitudinal sectional view along sections lines 5-5 in FIG. 4 showing the three pin fasteners securing the textile jet assembly together.

FIG. 18 is a top view of the dual channel jet of FIG. 15.

FIG. 19 is a longitudinal sectional view taken along the sections lines 19-19 in

FIG. 18.

FIG. 20 is cross sectional view taken along the section lines 20-20 in FIG. 18.

FIG. 21 is a top plane view of the dual channel insert plate of the embodiment of FIG. 18.

FIG. 22 is an end view of the dual channel insert plate shown in FIG. 21.

FIG. 23 is a plane view showing the downwardly facing face of the dual channel impact plate.

FIG. 24 is an end view of the dual channel impact plate of FIG. 23.

DETAILED DESCRIPTION OF THE PREFERRED EMBODIMENTS

Figure 1:
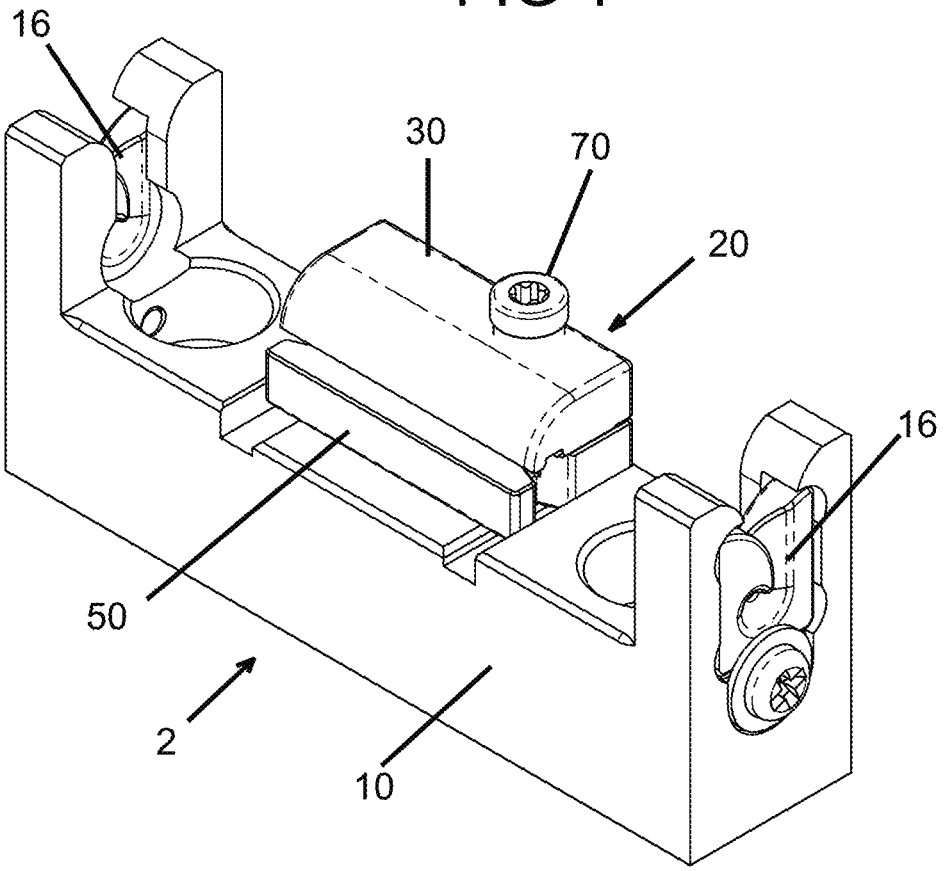
FIG. 1 is a three dimensional view of a textile jet assembly according to this invention in which the impact plate and insert plate have been assembled to a base support.
Figure 2:
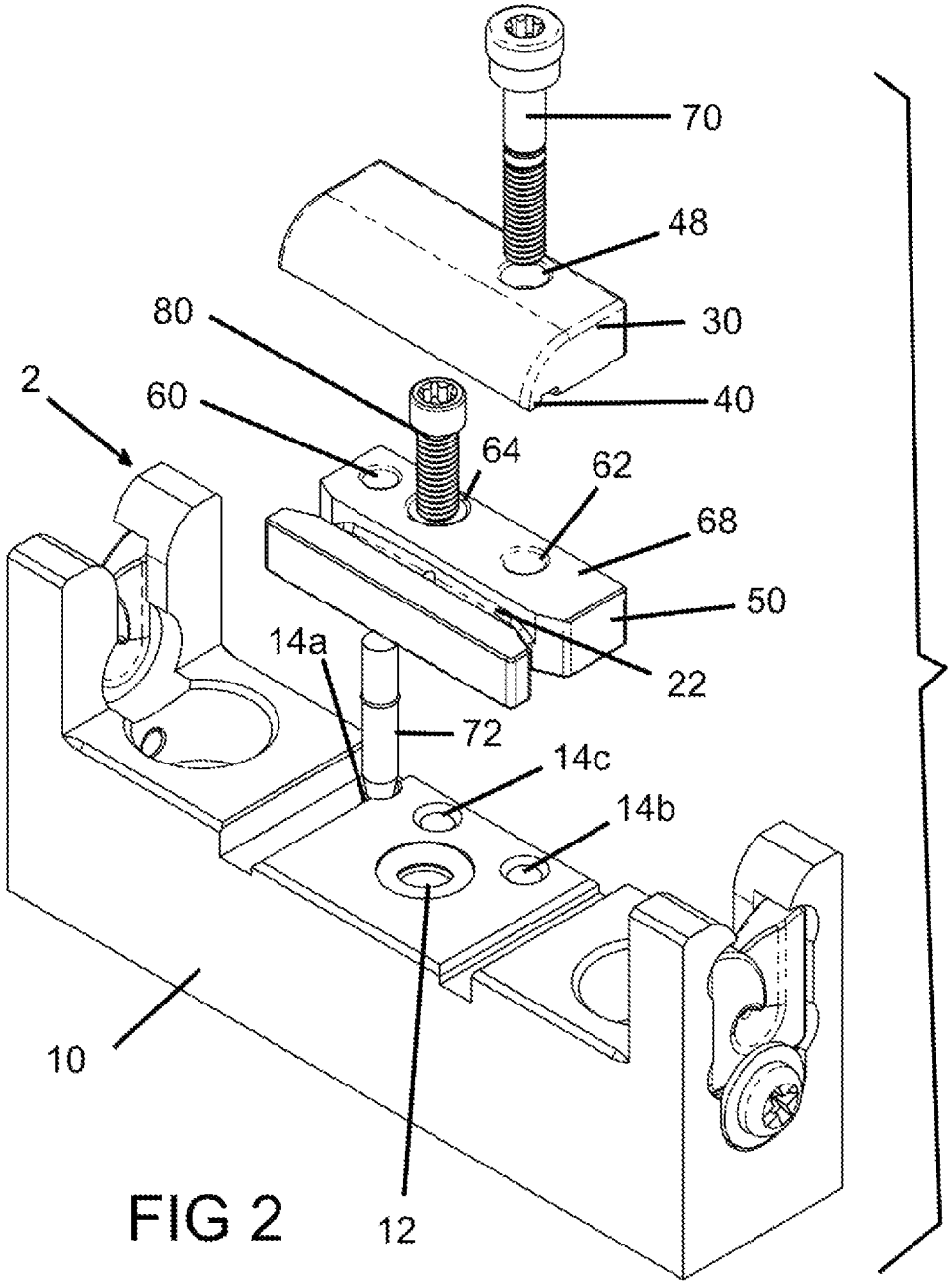
FIG. 2 is an exploded three dimensional view showing the major components of the textile jet assembly of FIG. 1.
Figure 3:
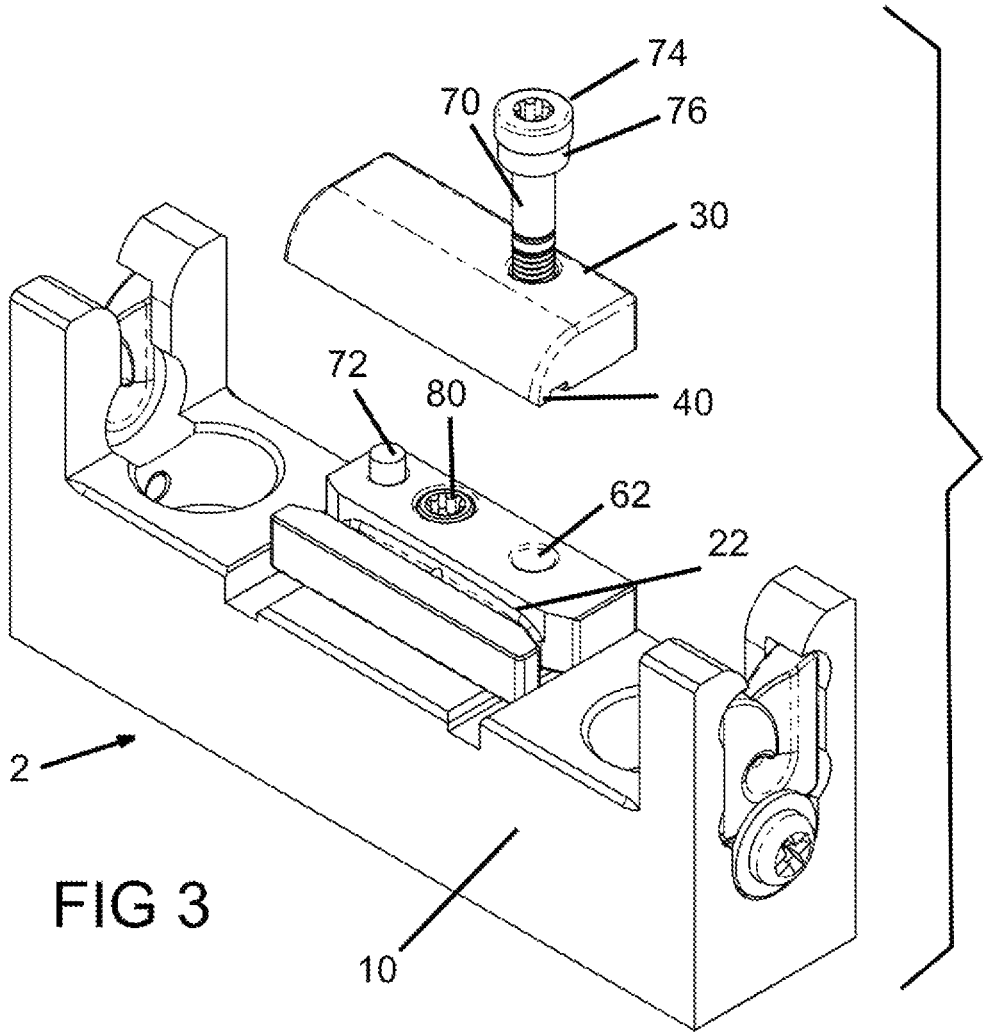
FIG. 3 is a partially exploded view similar to FIG. 2 in which the insert plate is mounted on the base support with the impact plate exploded above the insert plate, and showing the lower portion of the yarn channel.
Figure 6:
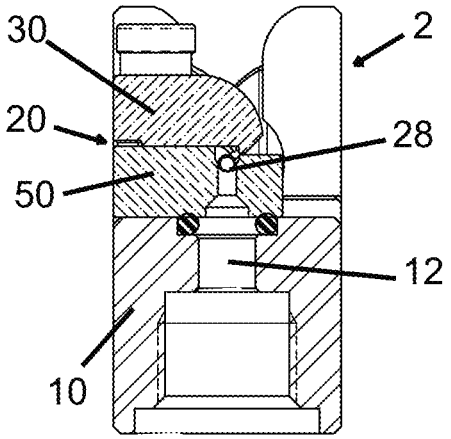
FIG. 6 is a cross sectional view along the section lines 6-6 in FIG. 4 taken through the jet orifice.
Figure 7:
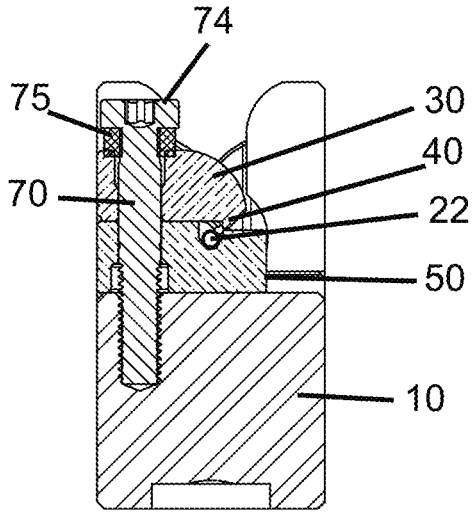
FIG. 7 is a cross sectional view along the section lines 7-7 in FIG. 4 showing a partially threaded pin fastener.

A textile jet assembly 2 according to the preferred embodiment of this invention is shown in FIGS. 1-3. This assembly 2 includes a jet or jet nozzle 20 including an upper impact plate 30 and a relatively lower insert plate 50. The impact plate 30 is secured to a lower insert plate 50 to form a yarn channel 22 between the two plates. A threading slot 29 communicating with the yarn channel 22 between the impact plate 30 and the insert plate 50 allows the multiple textile filaments to be positioned within the yarn channel 22 before they can be drawn through the textile jet or jet nozzle 20 and the high intensity air jet. The impact plate 30 and the insert plate 50 are mounted on a base support 10, which includes yarn guides 16 at either end. Multiple textile filaments are drawn into the jet or jet nozzle 20 from one end at a relatively high speed and drawn out the opposite end. As shown in FIGS. 2 and 6, air at a relatively high pressure is injected through the base support and bore 12 into a jet orifice 28 in the insert plate 50, shown in FIG. 6, into the yarn channel 22 in the textile jet or jet nozzle 20. Vortices are formed in the yarn channel 22 by the transverse injection of air at a high speed. These vortices then interlace the multifilament yarn filaments forming knots or entanglements in the yarn filaments to form an interlaced multifilament yarn in the same manner as described in U.S. Pat. No. 5,964,015 and similar to that shown in U.S. Patent Application Publication 2009/0211219 A1. The discussion of the knotting or entanglement of multifilament yarns including in these two patent publications is incorporated herein by reference.

Figure 6A:
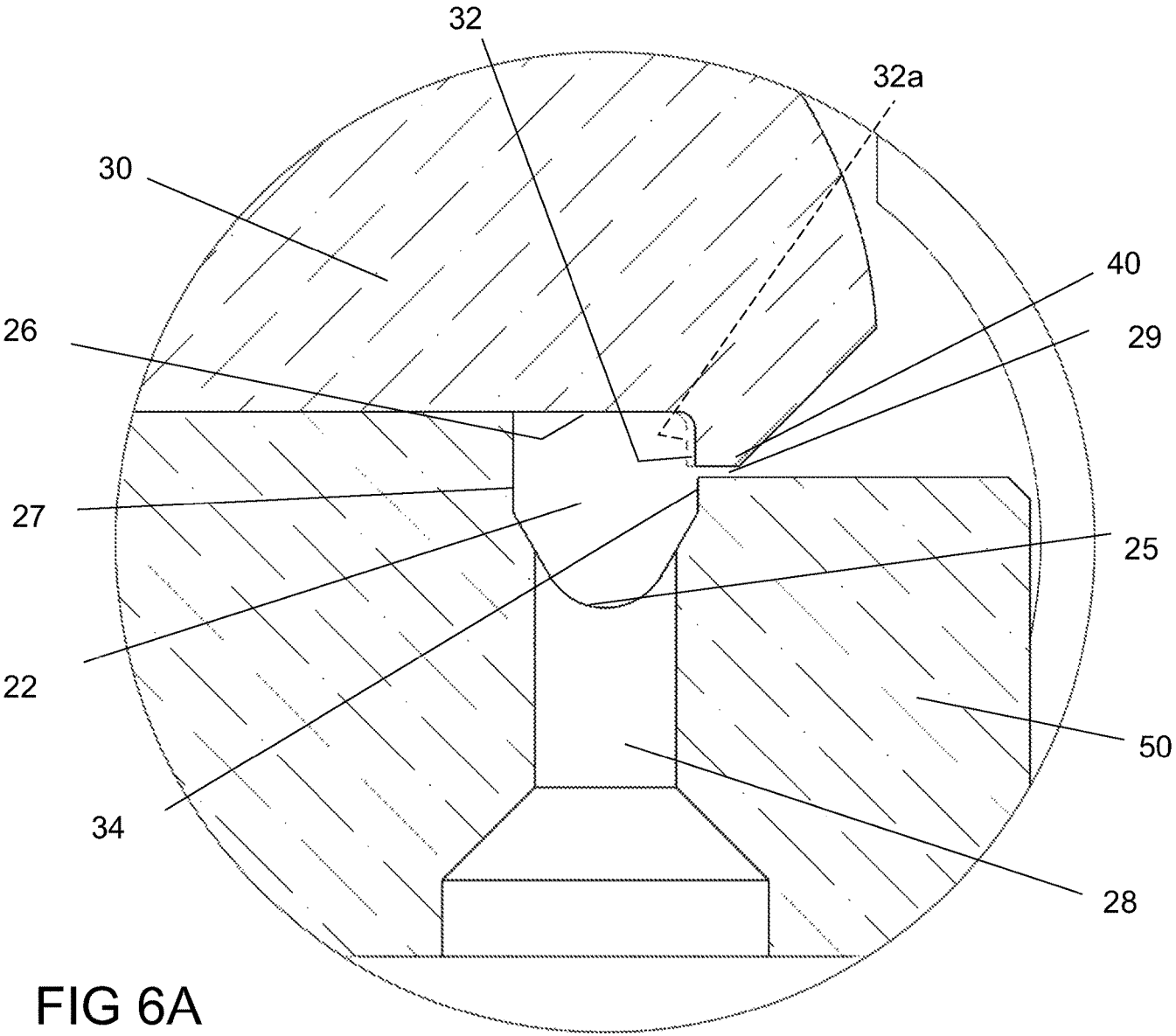
FIG. 6A is an enlarged view of the yarn channel at the jet orifice.
Figure 8:
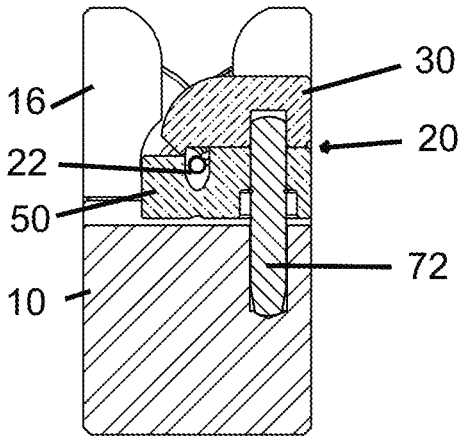
FIG. 8 is a cross sectional view along section lines 8-8 in FIG. 4 showing an unthreaded pin fastener extending through the lower insert plate and partially into the upper impact plate.
Figure 10:
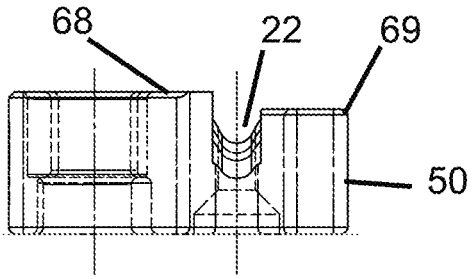
FIG. 10 is an end view of the insert plate.

As with the yarn channel in U.S. Pat. No. 5,964,015, the planar alignment of the side wall surfaces 32 and 34 of the yarn channel 22 above and below the threading slot 29 is important in the instant invention. This alignment is shown in FIG. 6A. The yarn channel wall opposite wall surfaces 32 and 34 is formed only in the insert plate 50 and abuts a downwardly facing wall on the impact plate 30. Two registration recesses or at least partially cylindrical bores 42, 48 in the impact plate 30 and three holes, bores or registration recesses 60, 62, 64 in the insert plate 50 together with three pins or pin fasteners 70, 72, 80 insure this planar alignment. The centerlines of each of the holes, bores or registration recesses 42, 48, 60, 62 and 64 are spaced from one edge of the yarn channel 22 and are all on one side only of the yarn channel 22. The three registration pins, or pin fasteners 70, 72, 80, when inserted into corresponding aligned recesses, bores or hole 42, 48, 60, 62 and 64 will also be in a on the same one side of the yarn channel 22. Two registration pins 70 and 72 will engage cooperating registration bores 62 and 60 at longitudinally spaced apart locations to align the side walls 32 and 34 of the yarn channel. Although it is desirable that the side wall surfaces 32 and 34 on opposite sides of the threading slot 29 be aligned to be coplanar, small misalignment of side wall surfaces 32 and 34 can still result in acceptable functionality. The phantom line in FIG. 6A represents the maximum side wall displacement 32*a* that will still provide satisfactory, if inferior, performance. This offset from a coplanar position however still requires that the spacing of the upper side wall (32 or 32*a*) be spaced from the opposed yarn channel side wall 27 by a distance that is no greater than the spacing of the lower side wall 34 from the opposed yarn channel side wall 27, which extends completely to and abuts the top wall 26 of the yarn channel. If the upper sidewall 32 is spaced from the opposite sidewall 27 than the lower side wall 34, the intensity of vortices formed by the impact of the air jet with the top yarn channel side wall 26 will be less resulting in a lower partial vacuum or pressure differential between the yarn channel and the exterior. This partial vacuum or negative pressure differential is necessary for the filaments to be drawn into the yarn channel 22 through the threading slot 29.

The insert plate 50 is wider than the impact plate 30, as seen in FIG. 2. As seen in FIG. 3, the insert plate 50 is mounted on the base support 10 before the upper impact plate 30 is attached on top of the lower insert plate 50. The base support 10, which can be fabricated from a suitable metal, has three bores or fastener holes 14*a*, 14*b* and 14*c* in a single line. Holes 14*b* and 14*c* are threaded to receive threaded fasteners 70 and 80 and include female thread profiles. The hole 14*a* is not threaded and will receive an unthreaded pin 72. The spacing between the three base support holes 14*a*, 14*b* and 14*c* is unequal and these three holes are asymmetrically located along the longitudinal direction of base support 10. As with prior art, the base supports for textile jet nozzles, the length of the base support 10 is greater than its width and includes a jet orifice 12. This is because the base supports 10, and the textile jets or jet nozzles mounted thereon can be mounted side by side in a dual yarn configuration as well as being used individually.

Modern melt spinning machines are more compact and require significantly closer thread line spacing. Current industry apparel yarn melt spinning machines require interlacing jets for: 4, 6, 8, 12 & 16 mm thread line spacing. Ceramic plate and fastener geometry utilized in U.S. Pat. No. 5,964,015 requires relatively broad ceramic plate widths. Scaling to facilitate close thread line requirement of 4, 6, 8, 12 & 16 mm is not possible due to complexities of manufacture and the physical properties of both the ceramic and fastener materials. Further the manufacturing cost of producing high precision Insert Plate and Impact Plate vertical interfacing alignment features has become prohibited. For these reasons the Insert Plate and Impact Plate alignment/fastening system utilized in U.S. Pat. No. 5,964,015 requires redesign and improvement, and the instant textile jet assembly 2 will be suitable for use on close spread line spacing that cannot be achieved by the jet nozzle assembly depicted in U.S. Pat. No. 5,964,015.

Industry standard for melt spinning machines producing apparel yarns (typical dtex range of approximately 11 to 660) requires interlacing jet channel proportions of approximately ~20 to 25 mm long with widths of approximately 1.2 to 3 mm. Corresponding minimum thread line spacing requirements are 4, 6, 8, 12 & 16 mm.

Industry standard for melt spinning machines producing industrial or carpet yarns (typical dtex range of approximately 400 to 6600) requires interlacing jet channel proportions of approximately ~25 to 36 mm long with widths of ~3 to 8 mm. Corresponding minimum thread line spacing requirement is 15 mm.

The preferred embodiment of the jet assembly 2 is suitable for ceramic plate profiles with Single Thread Line (ST) W=11.9 mm and Dual Thread Line (DT) W=7.8 to 15.9 both with L=20 to 25 mm. The preferred system depicted herein accommodates channel and thread line spacing requirements for modern apparel yarn melt spinning machines.

The preferred embodiment of the jet assembly is also suitable for ceramic plate profile W=14.9 mm with L=25 to 36 mm plus new Insert Plate and impact plate alignment/fastening system accommodates channel proportions and thread line spacing requirements for modern industrial or carpet yarn melt spinning machines.

In the preferred embodiment, both the impact plate 30 and the insert plate 50 are manufactured from a ceramic material such as a micro grain alumina ceramic having a grain size of 2-7 microns. It should be understood however that both the base 20 and the top plate 40 could be machined from a metal or fabricated from equivalent materials known to those skilled in the art.

Figure 9:
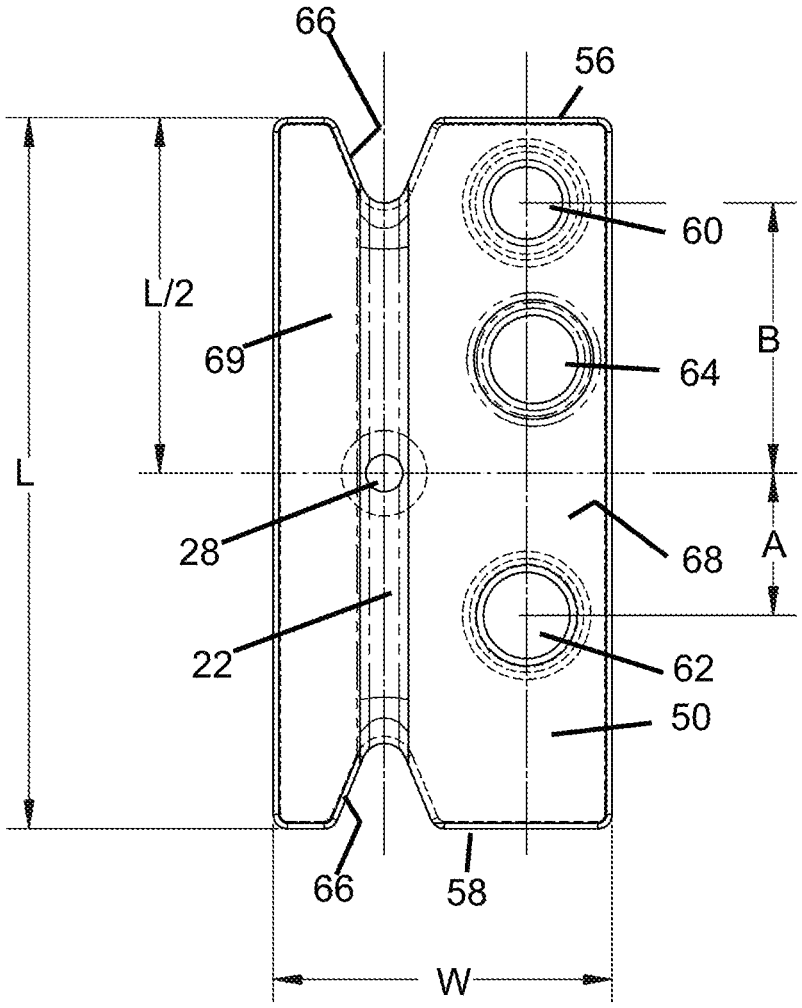
FIG. 9 is a top plane view of the insert plate showing a planar face beside the yarn channel and three aligned registration recesses.
Figure 11:
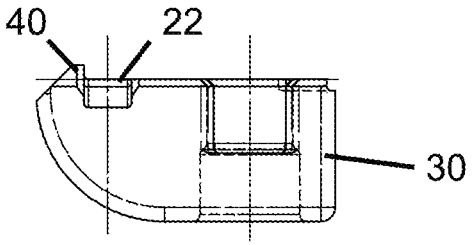
FIG. 11 is an end view of the impact plate.
Figure 12:
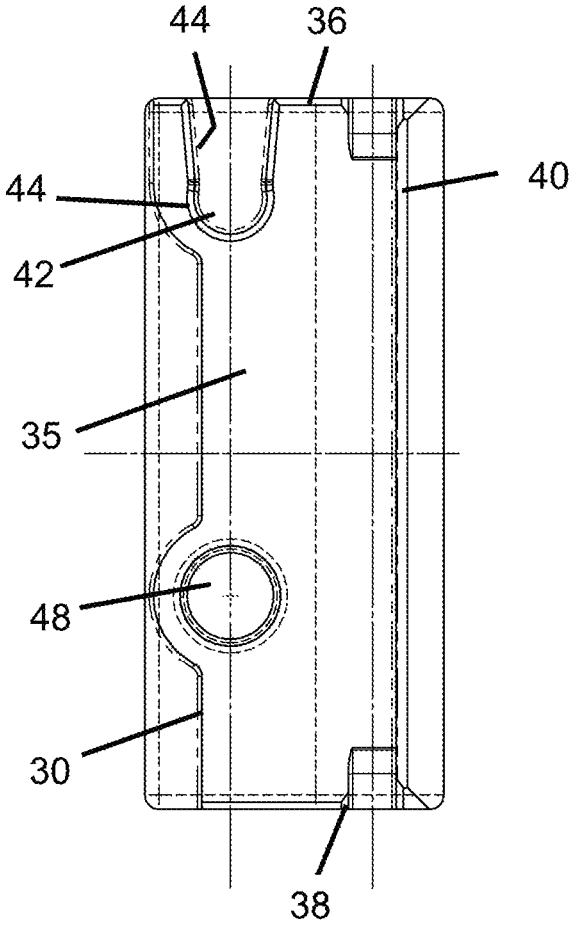
FIG. 12 is a view of the lower, downwardly facing planar face of the impact plate.
Figure 13:
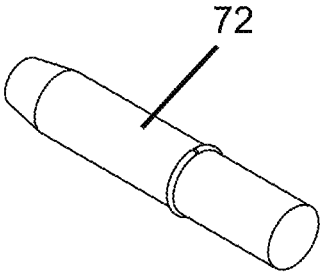
FIG. 13 is a three dimensional view of the unthreaded pin fastener.
Figure 14:
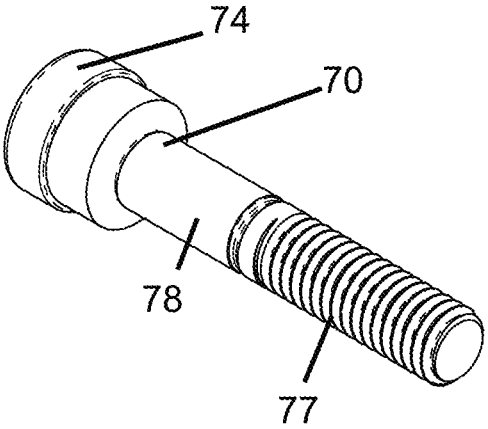
FIG. 14 is a three dimensional view of the clamp screw, which has a partially threaded section and an unthreaded section as well as a clamping sleeve adjacent the screw head.
Figure 17:
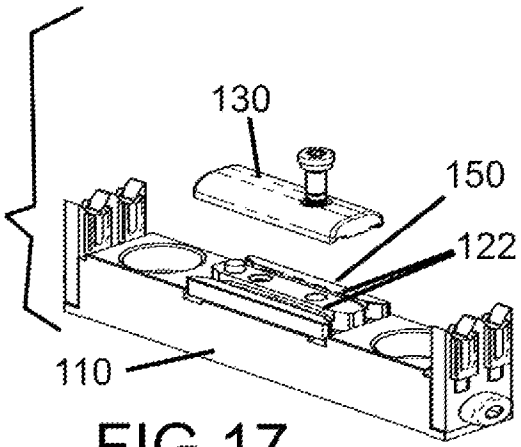
FIG. 17 is a partially exploded view similar to FIG. 16, but showing the insert plate mounted on the base support.
Figure 16:
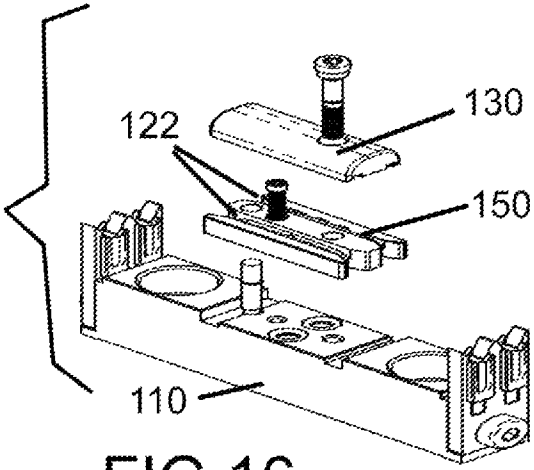
FIG. 16 is an exploded three dimensional view of the alternate embodiment of FIG. 15.
Figure 15:
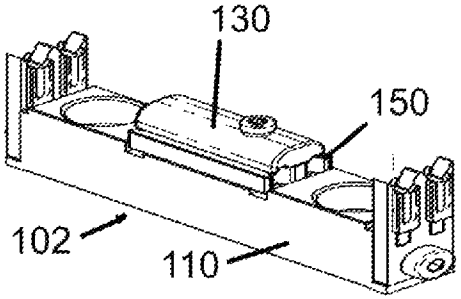
FIG. 15 is a three dimensional view of a dual channel alternate embodiment, otherwise similar to the single channel embodiment of FIG. 1.

The insert plate 50 is mountable directly on top of the base support 10 as seen in FIG. 2. The insert plate 50 includes a longitudinal groove extending between opposite first and second insert plate ends 56, 58 and this groove has an internal first channel side wall 52 and a second, opposed channel side wall 54. The insert plate 50 has a convex surface 25 forming the lower surface of the yarn channel 22. The three insert holes 60, 62 and 64 extend through the insert plate 50 from the top surface to the bottom surface. The top insert surface includes an upwardly facing planar surface 68 on one side of the yarn channel 22. Only the three insert mounting and alignment holes 60, 62 and 64 interrupt this upwardly facing planar surface. As seen in FIG. 9, the asymmetric spacing of holes 60, 62 and 64 results in a relatively larger upwardly facing surface surrounding the mounting and alignment hole 62 than the area surrounding the other two holes 60 and 64. This larger surface surrounding insert alignment hole 62 provides a relatively large bearing area for engaging a downwardly facing surface on the impact plate 30. This reduces the possibility of fracture or other damage to either the impact plate 30 and the insert plate 50. Each of the mounting and alignment holes 60, 62 and 64 are unthreaded.

A jet orifice 28 extends from the bottom surface of insert plate 50 into the yarn channel 22. The upwardly facing surface 69 on the opposite side of the yarn channel 22 is recessed relative to the planar surface 68. The surface 69 will form the lower surface of a threading slot when the impact plate 30 is mounted on top of the insert plate 50. Diverging yarn channel sections 66 are located at each end of the insert plate 50 and the yarn channel 22 to permit smooth entry and exit of the yarn of the multiple filaments and the interlaced yarn.

The impact plate 30 is mountable on top of the insert plate 50, which is located between the base support 10 and the impact plate 30. The high velocity air jet exiting the lower jet orifice 28 impacts on the upper yarn channel surface 26 on formed by the impact plate 30, hence the term impact plate. When the high velocity air jet strikes the flat surface 26, two oppositely rotating vortices are formed, which will engage and interlace the multiple yarn filaments to form a knotted or interlaced multifilament yarn, which exits the jet or jet nozzle 20.

Impact plate 30 has a lip 40 extending longitudinally from a first to a second end 36, 38 of the impact plate 30. Oppositely facing internal side walls 32 and 34 form the opposed upper side walls of the yarn channel 22. The internal impact plate side wall 32 needs to be in the same plane as the first insert plate internal side wall to form a smooth yarn channel surface that will not adversely affect the integrity of the vortices or degrade or abrade the yarn or yarn filaments. The alignment system between the impact plate 30 and the insert plate 50 results in this smooth, planar yarn channel wall 24. In this embodiment, impact registration recess 42 extends only partially through the impact plate 30, while a second registration recess 48 comprises a hole extending from the top to the bottom of impact plate 30. Both recesses are at least partially cylindrical. Recess or hole 48 is a complete right circular cylindrical recess, while registration recess 42 comprises a slotted hole which is only partially cylindrical. The slotted registration recess 42 has a semicylindrical section 44 and an open ended slot or slotted section comprising a pair of oppositely facing diverging walls 46. This shape permits the top of the first registration pin, which is unthreaded, to be laterally inserted into a close tolerance fit with the semicylindrical section 44. The depth of recess 42 is approximately equal to the extent to which the first unthreaded registration pin 72 protrudes above the insert plate 50. As apparent from FIG. 2, the other registration recess or bore 48 as well as alignable insert plate bore 62 have diameters approximately the same as an unthreaded section of the clamping and alignment pin 70. The unthreaded sections of these two pins 70 and 72, and the spacing between the cooperating recesses 42 and 48 provide for precise alignment of the impact plate 30 relative to the insert plate 50 in the desired orientation of the yarn channel especially so that the internal side walls 32 and 52 above and below the threading slot 29 will be aligned forming a smooth surface that will not degrade the yarn interlaced by jet or jet nozzle 20. As used herein, align, alignment in the same plane and alignment means that the upper side wall will never be further from the yarn channel axis than the lower channel side wall no matter what the tolerances or tolerance stackup may be.

When the registration pin 70 is fully seated, the head 82 of the pin 70, and a compression sleeve 76 will engage the upper surface of the impact plate 30. The compression sleeve 76, which is more ductile than the pin head 82 will alleviate stresses which might otherwise damage the ceramic impact plate. The relatively large bearing surfaces 35 and 68, made possible by the asymmetric position of the pins, holes and recesses will allow stresses to be borne over a relatively large surface area.

To assemble the textile jet assembly 2, the tapered end of untreaded registration pin 72 is first positioned in the hole 14*a* in the base support 10, as can best be seen in FIG. 2. The insert plate 50 can then be mounted on the base support 10 with unthreaded pin 72 extending through a first hole 60 in the insert plate 50. Insert plate hole 60 is then aligned with base support plate 14*c* and a threaded mounting pin 80 is then inserted to these aligned holes and screwed into engagement with threads in the mounting hole 14*c*. The hole 64 in insert plate 50 is countersunk providing clearance for the head 82 on pin 80 so that top of pin 80 will not protrude above the upper surface of insert plate 50 when fully seated. At this point the impact plate 30 may be mounted on top of the insert plate 30. Preferably the downwardly facing surface 35 on the impact plate 30 should slide across the upwardly facing insert plate surface 68. In the field when assembling the impact plate 30 to the insert plate 50 it is advantageous to be able to slide the two mating surfaces 35 and 68 together. A sliding action facilitates removal of any minor residual debris which insures a gap free interface. It is for this reason a slot recess 42 on the impact plate 30 is provided to engage the unthreaded registration or alignment pin 72 which is preferable to a circular hole. The diverging walls 46 allow entry of the protruding portion of pin 72 as the upper impact plate 30 slides relative to the stationary lower insert plate 50. With the pin 72 properly seated against the semi-cylindrical section 44 of the recess 42, the impact plate hole 48 can be aligned with the insert plate hole 64 and the other threaded registration pin 70 can be inserted through these aligned holes and recessed to clamp the impact plate 30 to the insert plate 50 to form a yarn channel 22 with oppositely facing smooth, planar walls. Together the combination of three cylindrical holes, one slot and two fasteners achieves both accurate alignment and secure loading of the Impact Plate to the Insert Plate with a minimum number of components and features. Also the three cylindrical holes, one slot machined into the ceramic plates can be easily machined at the same time as all other features utilizing similar cutting tools as the required tolerances of these features to accurately function are comparable to the required tolerances of the channel features to achieve good interlacing performance. Therefore secondary operations are eliminated because they can be machined simultaneously using the same process.

In the field ease of internal cleaning and or inspection of the Impact Plate wear surface is greatly eased by utilizing only one fastener to secure the Impact Plate to the Insert Plate. The dual purpose Clamp Screw Assembly artfully facilitates this requirement.

In the field when the Impact Plate is removed for cleaning and or inspection it is advantageous that the Insert Plate and all other components remain secured. The Insert Plate is retained to the housings with a small retention screw and the Alignment Pin Assembly retained with a C-ring to facilitate this. Note however due to space limitations for dual thread line insert plates designed for 4 mm thread line pitches this retention screw may be omitted.

In the field over-torquing the Impact Plate Clamp Screw fastener or the Insert Plate retention screw fastener can break the ceramic plates. To protect from breakage the Clamp Screw Assembly is fitted with a plastic compression washer on top and then bottoms out in the threaded hole in the housing. The Insert Plate retention screw bottoms out in the threaded hole in the housing allowing it to float.

Minimum manufacture cost of the ceramic insert plate 50 and impact plate 30 and the alignment/fastening system is possible by limiting the assembly to:

A minimum number of components

A minimum number of features

Machining of required cylindrical and or planer features to be feasible without secondary operations.

In this representative single channel embodiment, a minimum number of components is facilitated by using one alignment or registration pin subassembly and one dual purpose clamp screw and registration subassembly which both aligns and fastens the plates together. The alignment pin subassembly engages in a cylindrical hole 60 in the insert plate 50 and a corresponding slot 42 in the Impact Plate. To optimize function its location should be as far as reasonable towards one end of both the insert plate 50 and impact plate, (Ref. Distance B from the center (L/2) of the insert plate 50 in FIG. 9 should be large relative to the distance between the hole 60 and the end 56 of the insert plate 50). The clamp screw subassembly then engages corresponding holes in both insert plate 50 and impact plate 30. Its location should be as far as possible from the registration or alignment pin 72 but with sufficient distance from the opposite end to insure vertical loading of the clamp screw subassembly to secure the top surface of the insert plate, (Ref. distance A in FIG. 9 should be smaller than distance B). This optimizes linear alignment by maintaining a relatively large spacing (A+B) while maintaining reasonably portions of (L relative to (A+B) as shown in FIG. 9) so the bottom surface of the impact plate 30 will be flush and firmly secured to insert plate 50 without a gap, so that there will be no tendency to tip or rotate relative to the preferred mating plane.

The preferred embodiment of this invention is a single tread jet assembly 2, which permits two relatively narrow single jet assemblies to be positioned side by side to accommodate close thread spacing characteristic of efficient yarn manufacture. However the same operational and fabrication advantages can be achieved by a dual thread assembly, such as that shown in FIGS. 15-24. In this alternate dual thread jet assembly 102, two yarn channels 122 can be defined by a mating impact plate 130 and insert plate 15 mounted to a base support 110. Two parallel channels 122 are formed in the two ceramic plates 130 and 150 in much the same manner as in the single channel plates 30 and 50. In this alternate embodiment the three registration, alignment and clamping recesses as well as the cooperation pin fasteners are position in a single line between the two channels 130. The same assembly method achieves the same results as discussed with respect to the preferred embodiment of FIGS. 1-14. The invention is not therefore limited to the representative embodiments depicted herein, but is consistent with the following claims.

I claim:

1. A jet assembly for air interlacing multifilament textile yarn comprising an insert plate and an impact plate forming a yarn channel and a threading slot and a jet orifice communicating with and centrally positioned relative to the yarn channel, the yarn channel having parallel first and second opposed sides and having a lower convex surface formed in the insert plate and an upper surface formed by the impact plate, the insert plate including a side wall forming a portion of the first yarn channel side below the threading slot, the impact plate including a lip having a side wall forming an upper portion of the first yarn channel side above the threading slot, two alignment pins for aligning the impact plate relative to the insert plate so that the side wall of the lip above the threading slot is spaced from the second opposed yarn channel side wall by a distance no greater than the side wall of the insert plate below the threading slot and the opposed second wall of the yarn channel, wherein the impact plate has a pair of alignment recesses and the insert plate also has a pair of alignment recesses wherein the alignment recesses in the impact plate and the insert plate are mutually alignable and are only on a same side of the channel as the two alignment pins, to receive the two alignment pins, engagement of the two alignment pins with the two alignment recesses orienting the side wall of the lip above the threading slot relative to the side wall of the insert plate below the threading slot when two alignment pins are received in the two mutually alignable alignment recesses wherein the insert and impact plates are mountable on a base only on the same side of the yarn channel as the two alignment pins and the first and second alignment recesses to form a narrow jet assembly on the base.

2. The jet assembly of claim 1 wherein the two alignment recesses in the insert plate comprises two holes extending through the insert plate.

3. The jet assembly of claim 2 wherein the two alignment recesses in the impact plate comprise one hole extending through the impact plate and a slot extending only partially through the impact plate.

4. The jet assembly of claim 2 wherein the insert plate includes only a single mounting hole between the alignment recesses on the insert plate with a mounting screw extending through the mounting hole but below the impact plate.

5. The jet assembly of claim 1 wherein the side wall on the lip above the threading slot and the side wall below the threading slot are alignable in the same plane by the receipt of the two alignment pins in the first and second alignment recesses on the same side of the yarn channel.

6. A textile jet assembly, for interlacing multifilament textile yarn, comprising a base support on which an insert plate and an impact plate are mounted to form a yarn channel, the insert plate being below the yarn channel and the impact plate being above the yarn channel with a threading slot on a first side of the yarn channel and with a jet orifice extending through the base support and the insert plate to communicate with the yarn channel between opposite ends thereof, wherein three pin fasteners, aligned along only a second side of the yarn channel opposite from the first side, secure the base support, the insert plate and the impact plate together so that faces of the yarn channel above and below the threading slot are coplanar to prevent abrasion of the textile yarn, one of the three pin fasteners extending only through the insert plate and into the base support to fasten only the insert plate to the base support, another one of three pin fasteners extending through the impact plate and the insert plate and into the base support, and still another of the three pin fasteners extending through the insert plate and only partially into the impact plate to form a slim textile jet assembly so that multiple textile jet assemblies may be positioned side by side on closely spaced centerlines to form a multijet assembly.

7. The textile jet assembly of claim 6 wherein the base support, the insert plate and the impact plate are assembled together by only the three pin fasteners.

8. The textile jet assembly of claim 6 wherein two of the three pin fasteners are threaded adjacent the ends thereof.

9. The textile jet assembly of claim 8 wherein the pin fastener extending through the insert plate and only partially into the impact plate is unthreaded.

10. The textile jet assembly of claim 9 wherein the pin fastener extending through the impact plate and the insert plate is unthreaded over a portion thereof that extends through the insert plate and the impact plate so that unthreaded portions extending through the insert plate and into the impact plate to provide closer tolerances for positioning the impact plate relative to the insert plate than could be maintained if tread extending through the insert plate and at least partially into the impact plate were threaded.

11. The textile jet assembly of claim 6 wherein the pin fastener extending only through the insert plate and into the base support is located between the other two pin fasteners.

12. The textile jet assembly of claim 6 wherein the spacing between the pin fastener extending through the insert plate and only partially into the impact plate and one end of the impact and insert plates is less than the spacing between the one of the fasteners extending through the impact plate and the insert plate and an opposite end of the impact and insert plates.

13. The textile jet assembly of claim 6 wherein the three pin fasteners are asymmetrically positioned between opposite first and second ends of the impact and insert plates.

14. The textile jet assembly of claim 6 wherein three pin fasteners are cylindrical and extend into bores in the impact plate, the insert plate and the base support.

15. The textile jet assembly of claim 14 wherein a slot forming the bore in the impact plate extends into a lower surface of the impact plate, but not through to an upper surface of the impact plate, the first bore in the impact plate having a semi-cylindrical surface merging with a diverging surface opening onto a first end of the impact plate.

16. The textile jet assembly of claim 15 wherein the bore extending through the insert plate is a right circular cylinder extending completely through the insert plate.

17. The textile jet assembly of claim 6 wherein two parallel yarn channels extend between opposite ends of the impact and insert plates with two of pin fasteners located between the two parallel yarn channels.

18. The textile jet assembly of claim 6 wherein the impact plate is narrower than the insert plate.

19. A textile jet assembly, for interlacing multifilament textile yarn, comprising a base support on which an insert plate and an impact plate are mounted to form a yarn channel, the insert plate extending below the yarn channel and the impact plate extending above the yarn channel with a threading slot on a first side of the yarn channel and with a jet orifice extending through the base support and the insert plate to communicate with the yarn channel between opposite ends thereof, wherein three pin fasteners, aligned along only a second side of the yarn channel opposite from the first side, secure the base support, the insert plate and the impact plate together, one of the three pin fasteners extending only through the insert plate and into the base support, another of the three pin fasteners extending through the impact plate and the insert plate and into the base support, and still another of the three pin fasteners extending through the insert plate and only partially into the impact plate to form a slim textile jet assembly so that multiple textile jet assemblies may be positioned side by side on closely spaced centerlines to form a multijet assembly.

20. The textile jet assembly of claim 19 wherein the still another of the pin fasteners extends only partially into the impact plate.

21. A textile jet assembly comprising an insert plate and a an impact plate forming a yarn channel and a threading slot therebetween, with a jet orifice extending through the insert plate to communicate with the yarn channel, wherein the textile jet assembly is mountable on a base support through which a high pressure jet flows into and through the jet orifice in the insert plate and into the yarn channel and; the textile jet assembly being characterized by two alignment pins extending though the insert plate and into the impact plate on only one side of the yarn channel to align the impact plate and the insert plate to form the yarn channel and threading slot therebetween wherein the two alignment pins are asymmetrically located relative to two opposite ends of the insert plate and the impact plate with one of the alignment pins being located relatively further from one of the two ends of the insert plate more closely adjacent thereto, than the other of the two alignment pins is located relative to the other of the two opposite ends of the insert plate to which the other of the two alignment pin is more closely adjacent, and wherein the two alignment pins are located on the same side of the yarn channel where the insert plate is mountable to the base support.

22. The textile jet assembly of claim 21 wherein the one alignment pin comprises a clamping and alignment pin extending through both the insert plate and the impact plate and the other alignment pin extends through the insert plate and partially into the impact plate.

23. The textile jet assembly of claim 22 wherein an insert mounting pin having a threaded end for attaching the insert plate to the support base is located between the clamping and alignment pin and the other alignment pin.

24. The textile jet assembly of claim 23 wherein the inset mounting pin, the clamping and alignment pin and the other alignment pin are in linear alignment with each other.

25. The textile jet assembly of claim 23 wherein the clamping and alignment pin is spaced further from the insert mounting pin than the other pin to form a larger bearing area surrounding the insert mounting pin.

26. The textile jet assembly of claim 21 wherein the clamping and alignment pin has an unthreaded section extending through aligned openings in the insert plate and the impact plate and a threaded section engagable with the base support.

27. The textile jet assembly of claim 26 wherein the other of the two alignment pins is unthreaded throughout its entire length.

28. The textile jet assembly of claim 27 wherein the other of the two alignment pins extends into a slotted opening in the impact plate.

29. A textile jet assembly comprising a insert plate and a impact plate forming a yarn channel and a threading slot therebetween, with a jet orifice extending through the insert plate to communicate with the yarn channel, wherein the textile jet assembly is mountable on a base support through which a high pressure jet flows into and through the jet orifice in the insert plate and into the yarn channel; the textile jet assembly including a clamping and alignment pin extending through the insert plate and the impact plate with one end of the clamping and alignment pin securing the textile jet assembly to a base support wherein the clamping and alignment pin includes an unthreaded central section extending with a close fit through aligned bores in the insert plate and the impact plate, and with an alignment pin spaced from the clamping and alignment pin on the same side of the yarn channel extending into aligned openings in the insert plate and impact plate, with the aligned openings also being spaced from the aligned bores through which the clamping and alignment pin extends, so that the alignment pin and the clamping and alignment pin act together with the aligned bores to precisely align the impact and insert plates relative to a desired orientation of the yarn channel.

30. The textile jet assembly of claim 29 wherein a compression sleeve is positioned on the clamping and alignment pin between a head on the clamping and alignment sleeve and the impact plate.

31. The textile jet assembly of claim 29 wherein the alignment pin extends through a circular opening in the insert plate and into a slot in the impact plate.

32. The textile jet assembly of claim 29 also including an insert plate clamping fastener in addition to the clamping and alignment pin on the same side of the yarn channel as the clamping and alignment pin.

33. A textile jet assembly comprising a an insert plate and a an impact plate forming a yarn channel and a threading slot therebetween, with a jet orifice extending through the insert plate to communicate with the yarn channel, wherein the textile jet assembly is mountable on a base support through which a high pressure jet flows into and through the jet orifice in the insert plate and into the yarn channel wherein two spaced apart pins extend through the insert plate and at least partially into the impact plate on the same side of the yarn channel, one of the pins being an unthreaded alignment pin extending into an open slotted semicylindrical section in the impact plate, with walls forming the open slotted semicylindrical section converging to a width substantially equal to alignment pin's diameter to precisely align the impact plate so that the yarn channel will extend in a desired orientation, and wherein the impact plate slides along the insert plate into a position in which the unthreaded alignment pin will be positioned in the open ended slot for orienting the yarn channel.

34. The textile jet assembly of claim 33 wherein the open ended slot extends only partially into the impact plate from a lower surface thereof so that the unthreaded alignment pin extends only partially into the impact plate.

35. The textile jet assembly of claim 33 wherein the impact plate slides along a top surface of the insert plate into a final position to remove any debris so that the insert plate and the impact plate maintain a close fit.

* * * * *